US005346608A

United States Patent [19]

Ströder et al.

[11] Patent Number: 5,346,608

[45] Date of Patent: Sep. 13, 1994

[54] METHOD FOR OBTAINING NEODYMIUM OR NEODYMIUM-IRON ALLOY BY ELECTROLYSIS OF MELTS CONTAINING NEODYMIUM COMPOUNDS

[75] Inventors: Ulrich Ströder, Johannesberg, Fed. Rep. of Germany; Jean-Jacques Duruz, Geneva, Switzerland; Jean-Louis Jorda, Neuville, France

[73] Assignees: Heraeus Elektrochemie GmbH, Hanau am Main; Moltech Invent SA, Luxembourg

[21] Appl. No.: 992,691

[22] Filed: Dec. 18, 1992

[30] Foreign Application Priority Data

Dec. 20, 1991 [DE] Fed. Rep. of Germany ..... 4142160

[51] Int. Cl.[5] ..... C25C 3/34; C25D 3/66

[52] U.S. Cl. ..... 205/231; 204/64 R; 204/71; 205/230

[58] Field of Search ..... 205/230, 231, 232; 204/64 R, 71

[56] References Cited

U.S. PATENT DOCUMENTS

| | | | |
|---|---|---|---|
| 4,088,548 | 5/1978 | Townsend | 205/230 X |
| 4,964,966 | 10/1990 | Moreland | 204/280 |
| 5,143,746 | 9/1992 | Inoue et al. | 427/34 |

FOREIGN PATENT DOCUMENTS

| | | |
|---|---|---|
| 0177233 | 4/1986 | European Pat. Off. . |
| 02894314 | 11/1988 | European Pat. Off. . |
| 0443730 | 8/1991 | European Pat. Off. . |
| 3729361 | 3/1989 | Fed. Rep. of Germany . |
| 90/01078 | 2/1990 | PCT Int'l Appl. . |

OTHER PUBLICATIONS

Chemical Abstracts, vol. 112 Abstract No. 225539p, 1990, & JP 02 04,994 [90 04,994], Tamamura, Hideo (Showa Denka K.K.) Sep. 1, 1990.

E. Morrice et al./U.S. Patent Bureau of Mines, "Direct Electrolysis of Rare-Earth Oxides to Metals and Alloys in Fluoride Melts," Report of Investigations No. 7146, U.S. Dept. of Interior, 1968.

Section Ch, Week 8833, Jul. 11, 1988 Derwent Publications Ltd., London, GB; Class M28, AN 88-232370 & JP-A-63 166 987 (Asahi Chemical Ind. KK) * Zusammenfassung *.

*Primary Examiner*—John Niebling
*Assistant Examiner*—William T. Leader
*Attorney, Agent, or Firm*—Frishauf, Holtz, Goodman & Woodward

[57] ABSTRACT

Neodymium and neodymium-iron alloys are obtained by electrolysis of a neodymium salt melt using magnetite as the anode material. The cathode is non-consumable or is made of iron to be consumed and form a neodymium-iron alloy. The electrolysis is preferably carried out under a protective atmosphere.

16 Claims, No Drawings

METHOD FOR OBTAINING NEODYMIUM OR NEODYMIUM-IRON ALLOY BY ELECTROLYSIS OF MELTS CONTAINING NEODYMIUM COMPOUNDS

CROSS-REFERENCE TO RELATED PATENT DOCUMENTS, THE DISCLOSURES OF WHICH ARE INCORPORATED BY REFERENCE:

German Patent Disclosure DE-OS 37 29 361, DRAXLER et al., corresponding Canadian Patent No. 1,032,262; and corresponding publication WO 89-02156, publ. Mar. 9 '89;

European Patent Specification 0 177 233 B1, ITOH+/SUMITOMO, published Apr. 9 '86;

European Patent Application 0 443 730 A1, INOUE+/TOKAI CARBON, published Aug. 28 '91 and corresponding U.S. Pat. No. 5,143,746;

Japanese Tokkyo (Koho 88-153,972) 90-004,994 TAMAMURA/SHOWA DENKO K.K.

CROSS-REFERENCE TO RELATED LITERATURE

E. Morrice et al./U.S. Bureau of Mines, "Direct Electrolysis of Rare-Earth Oxides to Metals and Alloys in Fluoride Melts," Report of Investigations No. 7146, U.S. Dept. of Interior, 1968.

FIELD OF THE INVENTION

The invention relates generally to a method for obtaining neodymium or neodymium-iron alloys by electrolysis of melts containing neodymium salts, using electrodes dipped into the melts. The melts are typically such of neodymium oxide, neodymium fluoride, alkali metal fluoride, and optionally alkali earth metal fluoride.

BACKGROUND

Metallic neodymium and neodymium-iron alloys, which currently find increasing use as materials for the manufacture of permanent magnets, e.g. the neodymium-iron-boron alloys discussed in German Patent Disclosure DE-OS 37 29 361, DRAXLER et al., can be made by electrolytic reduction of salt melts containing neodymium compounds. If it is desired to recover the neodymium-iron alloys, the electrolysis cell uses iron cathodes which are consumed to provide the iron.

In their 1968 report cross-referenced above, E. Morrice and co-authors suggest obtaining neodymium and neodymium-iron alloys under an inert atmosphere from a melt of 50 Mol-% lithium fluoride, 50 Mol-% neodymium fluoride, and neodymium oxide dissolved therein, using graphite anodes, and insoluble tungsten or molybdenum cathodes, or consumable iron cathodes.

Japanese Patent Application 02-004,994 (abstracted in Chemical Abstracts, Vol. 112, Abstract No. 225 539p, 1990) describes the electrolysis of melts of 65.9 weight-% (20 Mol-%) neodymium fluoride and 34.1 weight-% (80 Mol-%) lithium fluoride and of 2 weight-% neodymium oxide, 64.6 weight-% (20 Mol-%) neodymium fluoride and 33.4 weight-% (80 Mol-%) lithium fluoride with carbon anodes and carbon or iron cathodes. For consumption of the carbon powder generated during the electrolysis and floating to the melt surface, the melt is electrolyzed in an oxygen-containing atmosphere.

European Patent Application No. 0 177 233 B1 relates to the manufacture of neodymium-iron alloys by electrolysis of melts. Under a protective gas atmosphere, a melt or bath containing 35–76 weight-% neodymium fluoride, 20–60 weight-% lithium fluoride, 0–40 weight-% barium fluoride, and 0–20 weight-% calcium fluoride is electrolyzed with at least one carbon anode and at least one iron cathode. The neodymium separating out at the iron cathode reacts with the iron to form an alloy, and the resulting neodymium-iron alloy (which is fluid at the temperature of the bath) drops from the cathode into a container below. The electrolysis occurs at 770°–950° C. on application of direct current to the carbon anode with a current density of 0.05–0.60 A/cm$^2$ and to the iron cathode with a current density of 0.50–55 A/cm$^2$.

With progressively increasing duration of electrolysis, the carbon anodes, used in this conventional method, are eroded by oxidation, so that they must be continually adjusted, and replaced at regular intervals. The destruction of the anodes also contaminates both the molten bath, and the neodymium-iron alloys generated, with carbon and with any other impurities present in the anode material. Oxides and fluorides of the carbon escape into the atmosphere surrounding the electrolysis cell, and can raise environmental concerns.

Accordingly, it is an object of the present invention to provide anodes, for such an electrolysis method, which, compared to carbon anodes, are consumed less quickly and possess an improved chemical resistance to the molten baths. This will have the advantage of producing neodymium and neodymium-iron alloys of increased purity, which are needed in the manufacture of permanent magnet materials.

BRIEF DESCRIPTION OF THE INVENTION

Neodymium and neodymium-iron alloys, which are increasingly used in making permanent magnets, are typically produced by electrolysis of neodymium-containing molten fluoride baths. The carbon anodes used heretofore introduce impurities into the baths and into the resulting metals. The method of the present invention avoids such impurities by using magnetite instead of carbon as the anode material. The electrolysis is preferably carried out under a protective atmosphere.

DETAILED DESCRIPTION

The present invention uses magnetite as the anode material in an electrolytic cell for the recovery of neodymium or neodymium-iron alloys. One can either use anodes entirely of magnetite, or apply magnetite as a coating on an electrically conducting carrier material, e.g. iron as disclosed in EP 0 443 730 A1 and U.S. Pat. No. 5,143,746.

The anodes can be used either in compact form or as a hollow body. The latter is desirable whenever there is a tendency for the magnetite to decompose or be converted into a more-poorly-conducting iron oxide. In the case of porous magnetite material, a pressurized protective gas can be introduced into the hollow where it will pass out through the pores; in the case of dense, relatively unporous magnetite material, an underpressure (partial vacuum) or overpressure within the hollow body can be created. A protective gas under pressure is used to generate the overpressure.

The method has proven most effective with electrolysis at a melt temperature between 750° C. and 1100° C., under a protective atmosphere.

By "protective atmosphere," or "protective gas" we mean those gases or gas mixtures, or an atmosphere of those gases or gas mixtures, which form an inert protective atmosphere in order to prevent undesired reactions of the melt and of the electrodes, especially with atmospheric oxygen. Protective gases suitable for use in the present invention include, for example, helium, argon and nitrogen.

A suitable molten salt bath for the method of the invention consists of 2–5 weight-% neodymium oxide, 35–92 weight-% neodymium fluoride, 6–60 weight-% lithium fluoride, 0–40 weight-% barium fluoride, and 0–20 weight-% calcium fluoride.

A preferred molten salt bath has 2–4 weight-% neodymium oxide, 78–90 weight-% neodymium fluoride, and 8–20 weight--% lithium fluoride, and particularly one with 2 weight-% neodymium oxide, 80 weight-% neodymium fluoride, and 18 weight-% lithium fluoride.

The method can be carried out in any of the electrolysis cells which are known in the art as suitable for electrolysis of molten salt baths containing neodymium compounds, e.g. those described in the aforementioned article of E. Morrice et al. and in EP 0 177 233 B1, ITOH et al./SUMITOMO LIGHT METAL IND.

Suitable cathodes for practicing the method are those insoluble cathodes of heat-resistant (refractory) metals, preferably of tungsten or molybdenum or—for obtaining neodymium-iron alloys—consumable electrodes of iron. There can be one or multiple cathodes, which either dip into the melt, or are arranged horizontally on the floor of the electrolysis cell and are completely covered by the melt.

The advantages of the use of magnetite for anode material in place of the consumable carbon, in accordance with the invention, are a simpler mode of operation and a longer operating time. These advantages are due to the fact that the anodes need to be adjusted less often and replaced less frequently. Furthermore, the problems of carbon-anode-induced impurities in the melt and in the resulting alloys and of exhaust gas are substantially avoided. Neodymium-iron alloys made in accordance with the invention are, by reason of their purity, very suitable for the manufacture of permanent magnet materials.

The following examples further explain the method of the invention.

EXAMPLE 1

In a graphite crucible of a cell, such as that described by E. Morrice, a melt of 2 weight-% neodymium oxide, 80 weight-% neodymium fluoride, and 18 weight-% lithium fluoride is prepared. Electrolysis is carried out at a temperature of 1050° C., with a protective atmosphere of argon, and using a magnetite anode and a molybdenum cathode. The current is preferably about 55 amps, the cell voltage is about 25 V., the anodic current density about 0.8 A/dm$^2$, the cathodic current density is about 7 A/dm$^2$, and the duration of electrolysis about 3 hours. As the electrolysis proceeds, molten neodymium collects at the bottom of the cell where it can be recovered.

EXAMPLE 2

In a graphite crucible of a cell, such as that described by E. Morrice, a melt of 2 weight-% neodymium oxide, 80 weight-% neodymium fluoride, and 18 weight-% lithium fluoride is prepared. Electrolysis is carried out at a temperature of 980° C., with a protective atmosphere of argon, and using a magnetite anode and an iron cathode. The current is preferably about 55 amps, the cell voltage is about 29 V., the anodic current density about 0.8 A/dm$^2$, the cathodic current density is about 7 A/dm$^2$, and the duration of electrolysis about 2 hours. The alloy forming on the iron cathode consists of 72 weight-% neodymium and 28 weight-% iron. This alloy falls or drips from the iron cathode and is collected from the cell.

It will be appreciated that the instant specification is set forth by way of illustration and not limitation; that various modifications and changes can be made; and that features described for one embodiment used for others, without departing from the spirit and scope of the present invention.

What is claimed is:

1. In a method for obtaining neodymium or neodymium-iron alloy by electrolysis of a melt containing neodymium oxide, neodymium fluoride, alkali metal fluorides, and optionally alkali earth metal fluorides, using at least one anode and at least one cathode at least partially immersed in the melt, the improvement wherein the anode is a hollow body formed of magnetite and the electrolysis is carried out at a melt temperature from about 750° C. to about 1100° C.

2. A method according to claim 1, wherein said electrolysis is carried out under a protective gas.

3. The method according to claim 1, wherein said hollow body is formed of porous magnetite.

4. The method according to claim 3, further comprising the step of introducing a protective gas into said hollow body under pressure to force it out through the porous magnetite.

5. The method according to claim 1, wherein said hollow body is formed of dense, substantially pore-free magnetite.

6. The method according to claim 5, further comprising the step of generating an underpressure or partial vacuum condition in said hollow body.

7. The method according to claim 5, further comprising the step of generating an overpressure of protective gas in said hollow body.

8. The method according to claim 1, wherein said cathode is of a metal selected from the group consisting of tungsten and molybdenum, and neodymium is recovered.

9. The method according to claim 1, wherein said cathode is an iron cathode, and a neodymium-iron alloy is obtained.

10. The method according to claim 1, wherein a melt of 2–5 weight-% neodymium oxide, 35–92 weight-% neodymium fluoride, 6–60 weight-% lithium fluoride, 0–40 weight-% barium fluoride, and 0–20 weight-% calcium fluoride, is electrolyzed.

11. The method according to claim 10, wherein a melt of 2–4 weight-% neodymium oxide, 78–90 weight-% neodymium fluoride, and 8–20 weight-% lithium fluoride, is electrolyzed.

12. A method according to claim 11, wherein a melt of 2 weight-% neodymium oxide, 80 weight-% neodymium fluoride, and 18 weight-% lithium fluoride, is electrolyzed.

13. The method according to claim 10, wherein said cathode is of a metal selected from the group consisting of tungsten and molybdenum and neodymium is obtained.

14. The method according to claim 10, wherein said cathode is an iron cathode and a neodymium-iron alloy is obtained.

15. The method according to claim 1, wherein a melt of 2–5 weight-% neodymium oxide, 35–92 weight-% neodymium fluoride, 6–60 weight-% lithium fluoride, 0–40 weight-% barium fluoride, and 0–20 weight-% calcium fluoride, is electrolyzed; and said cathode is of a metal selected from the group consisting of tungsten and molybdenum, and neodymium is recovered.

16. The method according to claim 1, wherein a melt of 2–5 weight-% neodymium oxide, 35–92 weight-% neodymium fluoride, and 6–60 weight-% lithium fluoride, 0–40 weight-% barium fluoride, and 0–20 weight-% calcium fluoride, is electrolyzed; and said cathode is an iron cathode, and a neodymium-iron alloy is recovered.

* * * * *